US005355201A

United States Patent [19]

Hwang

[11] Patent Number: 5,355,201

[45] Date of Patent: Oct. 11, 1994

[54] LIQUID DEVELOPMENT SYSTEM

[75] Inventor: Shyshung S. Hwang, Penfield, N.Y.

[73] Assignee: Xerox Corporation, Stamford, Conn.

[21] Appl. No.: 93,941

[22] Filed: Jul. 21, 1993

[51] Int. Cl.[5] ..... G03G 15/10

[52] U.S. Cl. ..... 355/256; 118/659

[58] Field of Search ..... 355/256; 118/659, 660

[56] References Cited

U.S. PATENT DOCUMENTS

| | | | |
|---|---|---|---|
| 3,609,029 | 9/1971 | Egnaczak | 355/256 |
| 4,421,056 | 12/1983 | Schinke | 355/256 X |
| 4,851,317 | 7/1989 | Chuang et al. | 430/119 |
| 4,907,532 | 3/1990 | Mikelsons et al. | 118/659 |
| 4,918,487 | 4/1990 | Coulter, Jr. | 355/256 |
| 5,023,665 | 6/1991 | Gundlach | 355/256 |
| 5,078,088 | 1/1992 | Nishikawa | 118/659 |
| 5,081,499 | 1/1992 | Nakao et al. | 355/256 |
| 5,117,263 | 5/1992 | Adam et al. | 355/256 |
| 5,157,443 | 10/1992 | Anderson et al. | 355/256 |
| 5,231,454 | 7/1993 | Landa | 355/256 |

*Primary Examiner*—R. L. Moses
*Assistant Examiner*—Nestor R. Ramirez
*Attorney, Agent, or Firm*—H. Fleischer; J. E. Beck; R. Zibelli

[57] ABSTRACT

An apparatus in which an electrostatic latent image is developed with liquid toner. The apparatus has a liquid extruder that extrudes a thin film of liquid toner which is attracted to the electrostatic latent image forming a liquid image on a photoconductive surface. The extruder is electrically biased to a suitable magnitude and polarity to ensure that the liquid toner is attracted to the latent image. A vacuum is applied on the liquid toner as it is being attracted to the latent image so as to reduce the thickness of the layer coated thereon.

27 Claims, 3 Drawing Sheets

LIQUID DEVELOPMENT SYSTEM

This invention relates generally to an electrostatographic printing machine, and more particularly concerns an apparatus for developing a latent image with liquid toner.

In electrophotographic printing, a charged photoconductive member is exposed to a light image of an original document. The irradiated areas of the photoconductive surface are charged to record an electrostatic latent image thereon corresponding to the informational area contained within the original document. Generally, the electrostatic latent image is developed by bringing a developer mixture into contact therewith. A dry developer mixture usually comprises carrier granules having toner particles adhering triboelectrically thereto. Toner particles are attracted from the carrier granules to the latent image forming a toner powder image thereon. Alternatively, a liquid developer material may be employed. The liquid developer material includes a liquid carrier having toner particles dispersed therein. The liquid developer material is advanced into contact with the electrostatic latent image and the toner particles are deposited thereon in image configuration. After the toner particles have been deposited on the photoconductive surface, they are transferred to a copy sheet. Generally, when a liquid developer material is employed, the copy sheet is wet with both the toner particles and the liquid carrier. Thus, it becomes necessary to remove the liquid carrier from the copy sheet. This may be accomplished by drying the copy sheet prior to fusing the toner particles thereto or relying upon the fusing process to permanently fuse the toner particles to the copy sheet as well as vaporizing the liquid carrier adhering thereto.

Liquid development is frequently carried out with a rotating developer roll submerged or partially submerged in a liquid with a stationary electrode being employed to create the necessary electrostatic field between the developer roller and the photoconductive surface. In a system of this type, the full length of the photoconductive surface, including the interdocument gap and the non-imaging areas, are always coated with liquid developer material. This is wasteful of developer material and significantly increases the load placed upon the cleaning system in the printing machine. Thus, it is desirable to reduce the quantity of liquid developer material deposited on the photoconductive surface. The following disclosures may be relevant to some aspects of the present invention:

| |
|---|
| US-A-4,851,317<br>Patentee: Chuang et. al.<br>Issued: July 25, 1989<br>US-A-5,081,499<br>Patentee: Nakao et. al.<br>Issued: January 14, 1993<br>US-A-5,117,263<br>Patentee: Adam et. al.<br>Issued: May 26, 1992 |

The relevant portions of the foregoing patents may be briefly summarized as follows:

U.S. Pat. No. 4,851,317 discloses a toning station having a toner tank which holds liquid toner. The toner tank is generally pyramidal and with a V-shaped lower region. The lower region assists in the recirculation of the toner and eliminates stagnant zones that are present in U-shaped tanks. The side walls of the lower region of the tank are preferably inclined to allow the toner particles to drain to the apex of the tank. A toner reservoir is disposed within the tank. The toner reservoir is preferably electrically insulating. A toning member is supported on the upper edges of the reservoir. The toning member is an L-shaped member and extends transversely across substantially the full transverse dimension of the imaging member and conforms in exterior configuration thereto so to be cooperable therewith to define a flow channel therebetween. The toning member comprises a first non-conductive element and a second conductive element. The first element cooperates with a portion of the side wall of the reservoir to form a channel that terminates in an orifice. The orifice communicates with the flow channel. A centrifugal pump is provided for circulating the toner to the reservoir and back to the tank. When the toning station is in use, the liquid toner flows from the toner tank to the toner reservoir through the capillary channel and from the orifice into the channel and over the toning member. The second element is electrically biased. Toning occurs only in the presence of a bias potential in the region of the channel adjacent the conductive second element.

U.S. Pat. No. 5,081,499 describes a liquid development unit in which electrodes are positioned on one side of a master. Developing liquid is supplied between the master and the electrodes. Conductors contact the base of the master to generate an electrical field between the master and the electrodes to develop the photosensitive layer of the master.

U.S. Pat. No. 5,117,263 describes a multicolor electrostatic imaging system. A latent image is recorded on a photoconductive drum. An electrically biased development roller is spaced from the photoconductive drum. A multicolor liquid developer spray assembly sprays liquid toner containing electrically charged pigmented toner particles either onto a portion of the development roller, a portion of the photoconductive drum, or directly into a development region between the photoconductive drum and the development roller. Color specific cleaning blade assemblies are operably associated with the developer roller for separately removing residual amounts of each colored toner remaining on the developer roller after development. Each blade assembly is selectively brought into contact with developer roller when toner of a color corresponding thereto is supplied to the development region by the spray assembly. The multicolor toner spray assembly includes a linear array of spray outlets. Each spray outlet is connected to a conduit for furnishing the respective colored liquid toner from the corresponding reservoir. The spray outlets are interdigited such that when four colors are used, each fourth outlet sprays the same colored toner and each group of four adjacent outlets spray four different colors. Colored toner is sprayed under pressure from each of the outlets into the development region. The spacing of the spray outlets and their periodocity is selected to enable the toner for each individual color to substantially uniformly fill the development region. In this way, the latent image is developed with liquid toner.

In accordance with one aspect of the present invention, there is provided an apparatus for developing an electrostatic latent image with a liquid toner. The apparatus includes a member comprising a lip adapted to supply the liquid toner to the latent image to develop the latent image with a layer of liquid toner. Means are provided for reducing the pressure on the liquid toner as the member applies the liquid toner on the latent image to reduce the thickness of liquid toner on the latent image.

Pursuant to another aspect of the present invention, there is provided an electrostatic printing machine including an imaging surface. Means are provided for recording an electrostatic latent image on the imaging surface. Means develop the electrostatic latent image recorded on the imaging surface with a liquid toner. The developing means comprises a member having a lip adapted to supply the liquid toner to the latent image to develop the latent image with a layer of liquid toner. Means electrically bias the lip to attract the liquid toner from the lip to the electrostatic latent image. Means reduce the pressure of the liquid toner as the member applies the liquid toner on the latent image to reduce the thickness of the liquid toner on the latent image.

Pursuant to still another aspect of the present invention, there is provided a multicolor electrostatic printing machine including an imaging surface. Means record a plurality of electrostatic latent images on the imaging surface. Means develop each of the electrostatic latent images recorded on the imaging surface with a different color liquid toner. The developing means comprises a plurality of members with each of the plurality of members having a lip adapted to supply the liquid toner to the latent image to develop the latent image with a layer of liquid toner. Means reduce the pressure of the liquid toner as the member applies liquid toner on the latent image to reduce the thickness of liquid toner on the latent image.

Other aspects of the present invention will become apparent as the following description proceeds and upon reference to the drawings, in which.

While the present invention will hereinafter be described in connection with various embodiments thereof, it will be understood but is not intended to limit the invention to these embodiments. On the contrary, it is intended to cover all alternatives, modifications, and equivalents as may be included within the spirit and scope of the invention as defined by the appended claims.

Figure 7:
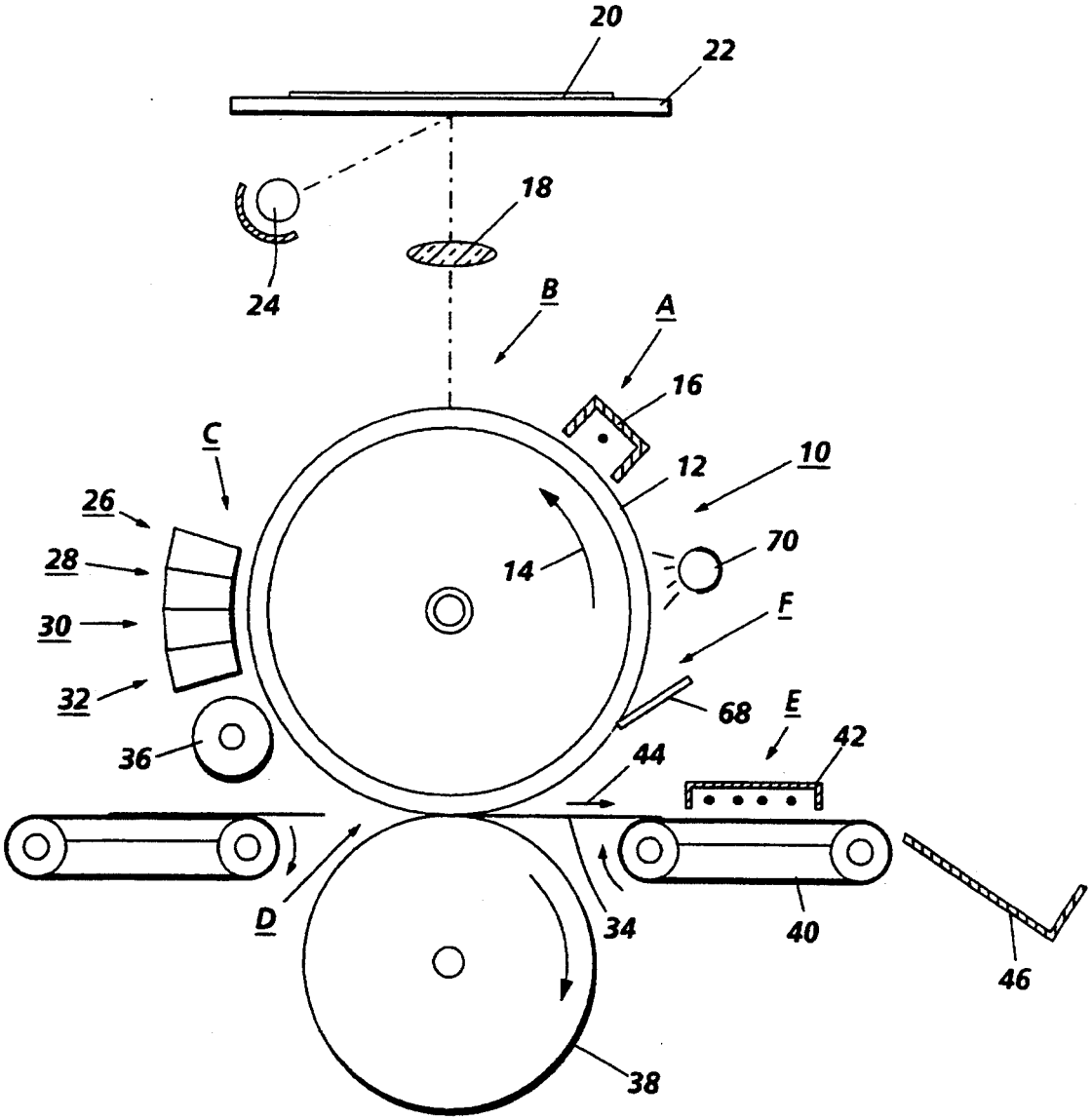
FIG. 7 depicts a multicolor electrophotographic printing machine utilizing the liquid extruders described in FIGS. 1–6, inclusive.

For a general understanding of the features of the present invention, reference is made to the drawings. In the drawings, like reference numerals have been used throughout to designate identical elements. FIG. 7 is a schematic elevational view illustrating an electrophotographic printing machine incorporating the features of the present invention therein. It will become apparent from the following discussion that the apparatus of the present invention may be equally well suited for use in a wide variety of printing machines and is not necessarily limited in its application to the particular embodiment.

Turning now to FIG. 7, the electrophotographic printing machine employs a photoconductive member having a drum 10 mounted rotatably within the printing machine. A photoconductive surface 12 is mounted on the exterior circumferential surface of drum 10 and entrained thereabout. A series of processing stations are positioned about drum 10 such that as drum 10 rotates in the direction of arrow 14, it passes sequentially therethrough. Drum 10 is driven at a predetermined speed relative to the other machine operating mechanisms by a drive motor. Timing detectors sense the rotation of drum 10 and communicate with the machine logic to synchronize the various operation thereof with the rotation of drum 10. In this manner, the proper sequence of events is produced at the respective processing stations.

Drum 10 initially rotates the photoconductive surface 12 through charging station A. At charging station A, a corona generating device, indicated generally by the reference numeral 16, sprays ions onto photoconductive surface 12 producing a relatively high, substantially uniform charge thereon.

Next, the charged photoconductive surface is rotated on drum 10 to exposure station B. At exposure station B, a light image of an original document is projected onto the charged portion of the photoconductive surface 12. Exposure station B includes a moving lens system, generally designated by the reference numeral 18. An original document 20 is positioned face down on a generally planar, substantially transparent patent 22. Lamps 24 are adapted to move in a timed relationship with lenses 18 to scan successive incremental areas of original document 20. In this manner, a flowing light image of original document 20 is projected onto the charged portion of photoconductive surface 12. This selectively dissipates the charge on photoconductive surface 12 to record an electrostatic latent image thereon corresponding to the informational areas in original document 20. Selected optical filters (not shown) having colors complimentary to the color of the respective liquid toner are interposed into the light path to optically filter the light image. While a light lens system has heretofore been described, one skilled in the art will appreciate that other techniques may be used, such as a raster output scanner employing a modulated laser beam to discharge selected areas of the photoconductive surface to record the electrostatic latent image thereon.

After exposure, drum 10 rotates the electrostatic latent image recorded on photoconductive surface 12 to development station C. Development station C includes a plurality of developer units, generally indicated by the reference numerals 26, 28, 30 and 32. Each of the developer units are substantially identical to one another and will be described hereinafter in greater detail with reference to FIGS. 1–6 inclusive. Each developer unit extrudes a liquid developer material onto the electrostatic latent image so as to develop the electrostatic latent image with the respective colored toner particles. By way of example, developer unit 26 extrudes cyan colored liquid toner, developer unit 28 extrudes magenta colored liquid toner, developer unit 30 extrudes yellow colored liquid toner, and developer unit 32 extrudes black colored liquid toner. In operation, a filter is employed in association with lens 18 so that a selected color is transmitted onto photoconductive surface 12 to selectively discharge portions thereof. For example, a red filter is employed to discharge selected areas with the charged areas being developed with the subtractive primary of red, i.e. cyan colored liquid toner. Thus, developer unit 26 develops the charged areas with cyan colored liquid toner when a red filter is employed in association with lens 18. Similarly, when a green filter is employed, developer unit 28 is energized to develop the charged areas with magenta colored liquid toner and, when a blue filter is employed, developer unit 30 is energized to selectively develop the charged area with yellow colored liquid toner. Finally, for those regions of the original documents desired to be reproduced in black, developer unit 32 is energized to develop the charged areas with black colored liquid toner. Each developer unit is selectively actuated during a repeated cycle. By that, it is meant that during the first cycle, when the red filter is employed, developer unit 26 is energized. Subsequently, during the next successive cycle, when the green filter is employed, developer unit 28 is energized. During the third cycle, when the blue filter is employed, developer unit 30 is energized and, finally, during a fourth cycle, developer unit 32 is energized.

Each liquid image may be transferred to a copy sheet after its respective cycle, or successive liquid images may be developed in superimposed registration with one another on photoconductive surface 12 forming a composite multicolor liquid image. The composite multicolor liquid image may then be transferred to the copy sheet 34 after the fourth cycle.

In the electrophotographic printing machine depicted in FIG. 7, a multicolor liquid toner image, i.e. a composite toner image, is formed on photoconductive surface 12 and transferred to a copy sheet. The toner image is transferred at transfer station D.

At transfer station D, the composite multicolor liquid image is transferred to copy sheet 34. Prior to transferring the multicolor liquid image to copy sheet 34, a conditioning roller 36 contacts the multicolor composite liquid toner image. By way of example, conditioning roller 36 may be an electrically biased squeegee roller which is urged against the surface of drum 10 to remove liquid carrier from the background region and to compact the image and remove liquid carrier therefrom in the image regions. Squeegee roller 36 is preferably formed of resilient, slightly conductive polymeric material and is charged to a potential of from several hundred to a few thousand volts with the same polarity as the polarity of the charge on the toner particles. After the composite multicolor liquid image has been conditioned, it advances to transfer station D. A transfer roller 38 is maintained at a suitable voltage and temperature for electrostatic transfer of the image from photoconductive surface 12 to copy sheet 34. Preferably, transfer roller 38 applies pressure and is electrically biased to ensure the transfer of the composite multicolor liquid image to sheet 34.

After the composite multicolor liquid image has been transferred to copy sheet 34, the copy sheet advances on conveyor 40 through fusing station E. Fusing station E includes a radiant heater 42 which radiates sufficient heat energy to permanently fuse the toner to copy sheet 34 in image configuration. Conveyor belt 40 advances the copy sheet in the direction of arrow 44, through radiant fuser 42 to catch tray 46. When copy sheet 34 is located in catch tray 46, it may be readily removed therefrom by the machine operator.

With continued reference to FIG. 7, invariably, some residual liquid toner remains adhering to photoconductive surface 12 of drum 10 after the transfer thereof to copy sheet 34. This material is removed from photoconductive surface 12 at cleaning station F. Cleaning station F includes a flexible resilient blade 68. This blade has the free end portion thereof in contact with photoconductive surface 12 to remove any material adhering thereto. Thereafter, lamp 70 is energized to discharge any residual charge on photoconductive surface 12 preparatory for the next successive imaging cycle. In this way, successive electrostatic latent images may be developed.

The development system of the present invention may be utilized in a multicolor electrophotographic printing machine or, in a monocolor printing machine. The developed image may be transferred directly to the copy sheet or to an intermediate member prior to transfer to the copy sheet. Multicolor printing machines may use this type of development unit where successive latent images are developed to form a composite multicolor toner image which is subsequently transferred to a copy sheet or, in lieu thereof, single color liquid images may be transferred in superimposed registration with one another directly to the copy sheet.

The foregoing describes generally the operation of a electrophotographic printing machine including the development apparatus of the present invention therein. The detailed structure of the development apparatus will be described hereinafter with reference to FIGS. 1–6, inclusive.

Figure 1:
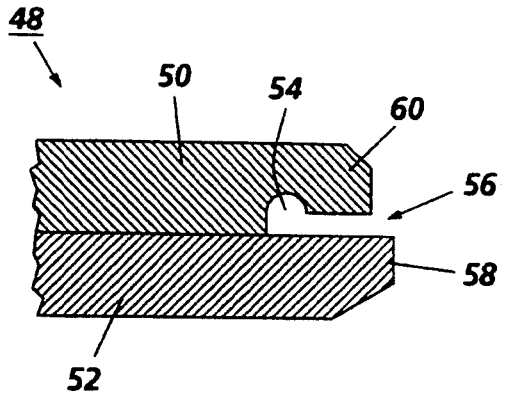
FIG. 1 is a fragmentary, sectional elevational view of the liquid extruder assembly incorporating the features of the present invention therein.

Referring now to FIG. 1, only developer unit 26 will be described as the other developer units are substantially identical thereto. The only distinction between developer units is the color of the liquid developer material being used.

Figure 2:
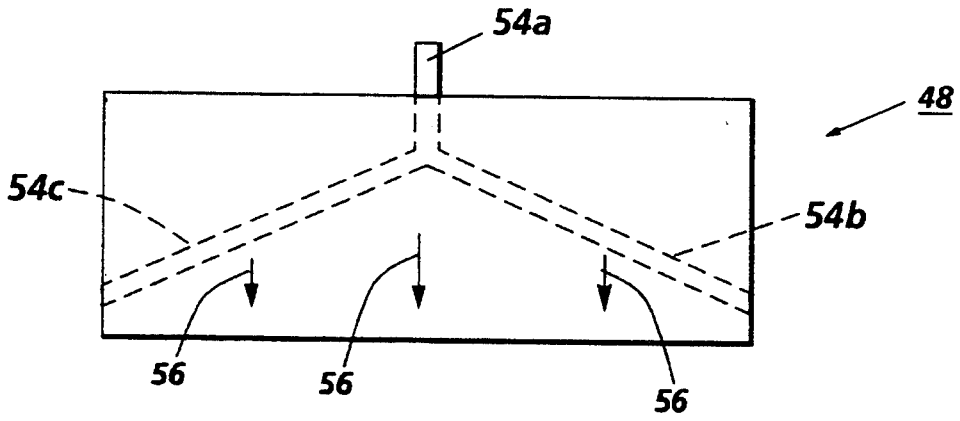
FIG. 2 is a plan view of one embodiment of the FIG. 1 liquid extruder.

As shown in FIG. 1, liquid extruder 48 includes a first member 50 and a second member 52. An open-ended channel 54 is formed in first member 50. A distribution channel 56 extends in a direction substantially transverse to channel 54. A plurality of distribution channels are located along the longitudinal axis of drum 10. The foregoing is shown more clearly in FIG. 2. As shown in FIG. 2, distribution channel 54 includes a first portion 54A connected to a supply of liquid developer material. Channels 54B and C intersect with channel 54A in a substantial V-shaped configuration to form a Y-shaped channel. A plurality of substantially equally spaced distribution channels 56 intersect with legs 54B and 54C of channel 54. Distribution channels 56 receive liquid developer material from channel 54 and guide the liquid developer material to lip 58. The angle of channels 54B and 54C with respect to distribution channel 56 ensure that the liquid developer material coats the lip 58 with a film having a straight leading and trailing edge. The angle of the incline of the channel and the cross-sectional diameter ensures substantially uniform distribution of liquid developer material along the lip 58. Lip 58 is a surface of second member 52 which is substantially parallel to the longitudinal axis of drum 10 and defines a gap therebetween. The gap between lip 58 and drum 10 is less than the gap between surface 60 of first member 50 and drum 10. Lip 58 is used to apply liquid developer material of a substantially uniform thickness to the latent image recorded on photoconductive surface 12 of drum 10. A metering pump is used to pump requisite amount of liquid developer material for each electrostatic latent image from the supply of liquid developer material to liquid extruder 48.

Figure 3:
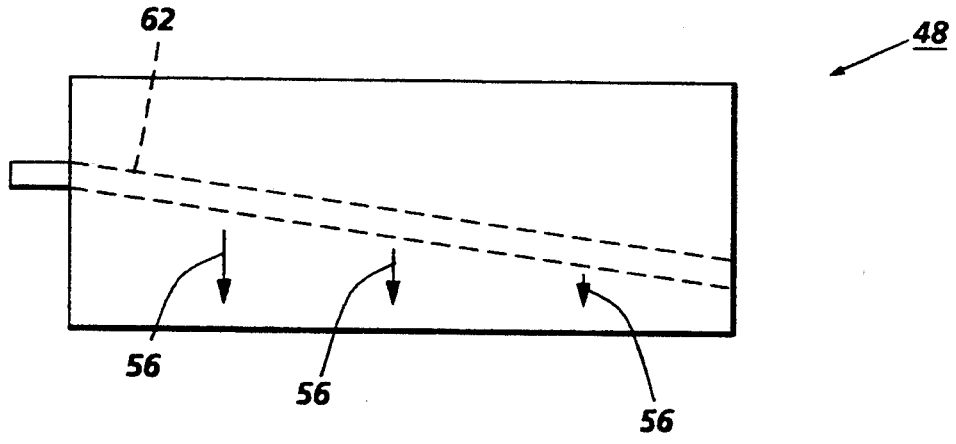
FIG. 3 is a plan view of another embodiment of the FIG. 1 liquid extruder.

Turning now to FIG. 3, there is shown an alternative embodiment of the channel arrangement in liquid extruder 48. As depicted thereat, channel 62 is connected to the supply of liquid developer with distribution channels 56 being transverse thereto. Once again, the incline of channel 62 relative to distribution channels 56 is designed to ensure that lip 58 will apply liquid developer material of a substantially uniform thickness with straight leading and trailing edges on the latent image.

Figure 4:
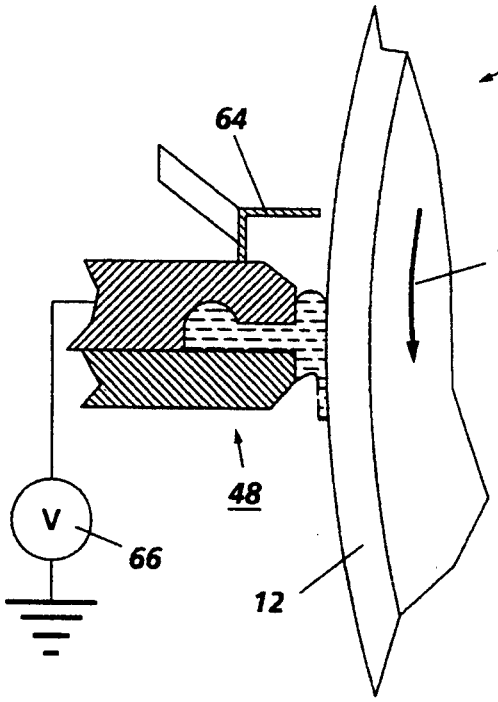
FIG. 4 is an elevational view, partially in section, depicting a vacuum system and a voltage source associated with the FIG. 1 liquid extruder.

Referring now to FIG. 4, there is shown a vacuum pump 64 adapted to apply a vacuum at the upstream side of liquid extruder 48. Vacuum pump 64, reduces the pressure on the liquid, i.e. suctions the liquid toner upwardly. By applying a vacuum on the liquid developer material as it is being coated onto the photoconductive surface 12 of drum 10, the gap between the lip 58 and photoconductive surface 12 may be larger in order to obtain the same thickness of coating on photoconductive surface 12. By way of example, the gap between lip 58 and photoconductive surface 12 can be a maximum of seven times the thickness of the layer of developer material coated on photoconductive surface 12. A film thickness of less than 1 mil of liquid developer material can be achieved. This significantly relaxes the tolerance on the gap between lip 58 and photoconductive surface 12. Voltage source 66 electrically biases liquid extruder 48 to a suitable magnitude and polarity to ensure that the electrostatic latent image recorded on photoconductive surface 12 attracts the liquid developer material thereto.

Figure 5:
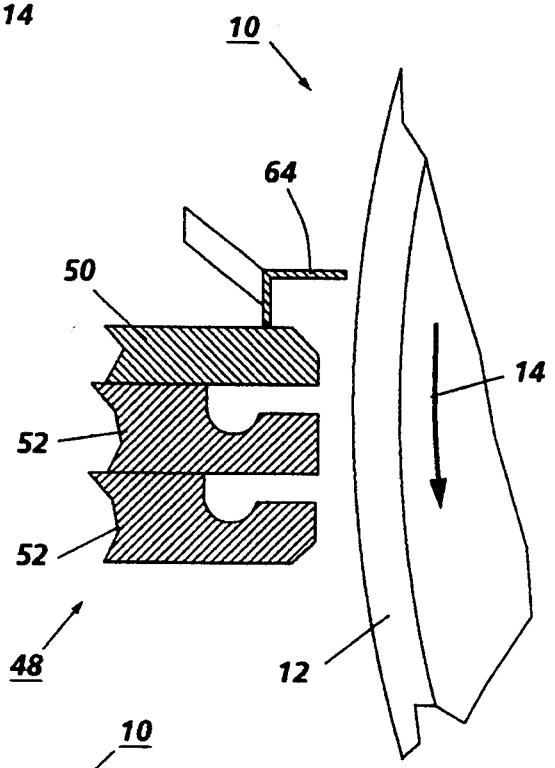
FIG. 5 depicts a vacuum system associated with a plurality of FIG. 1 liquid extruders.

As shown in FIG. 5, one vacuum pump 64 may be associated with the plurality of liquid extruders 48. In addition, it should be noted that when a plurality of liquid extruders are employed, only one first member 50 is necessary. Thus, for the first extruder 48, first member 50 is associated with second member 52. For the next liquid extruder, the lower portion of second member 52 serves in the same capacity as first member 50 and first member 50 is not longer required. This reduces the size and complexity of the developer units.

Figure 6:
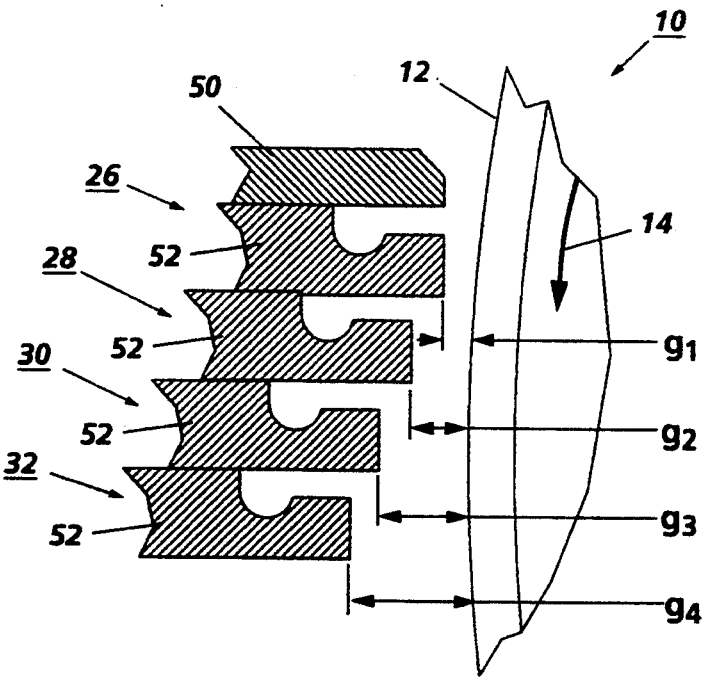
FIG. 6 illustrates a plurality of liquid extruders used in a multicolor printing machine.

For multiple colors, multiple liquid extruders may be employed. As shown in FIG. 6, the uppermost liquid extruder assembly 48 forming developer unit 26 includes both a first member 50 and a second member 52. The remaining liquid extruder assemblies 48 for developer units 28, 30, and 32, respectively, only require second members 52. Inasmuch as successive liquid toner images are deposited, in superimposed registration, with one another on photoconductive surface 12 of drum 10, the gap between lip 58 and the surface of the liquid toner is progressively decreasing. In order to maintain this gap substantially constant, the gap between successive lips must be staggered with respect to the photoconductive surface. Thus, the gap of successive lips 58 from photoconductive surface 12 increases in the direction of movement of drum 10, as indicated by arrow 14. As shown in FIG. 6, gap g4 is greater than gap g3, which, in turn, is greater than gap g2 which, in turn, is greater than gap g1.

A multicolor development unit using liquid extruders 48 may be constructed to have a height of about 1 inch. Thus, it is seen that a compact multicolor developer system may be achieved by utilizing liquid extruders of the present invention.

In recapitulation, developer unit of the present invention includes a liquid extruder having a first member and a second member. A supply channel is coupled to a pump for transporting liquid toner from a supply thereof to distribution channels. The distribution channels advance the liquid toner to a lip, which is a surface substantially parallel to longitudinal axis of the photoconductive drum A substantially uniform layer of liquid toner is metered onto the electrostatic latent image. The liquid extruder is electrically biased to a suitable magnitude and polarity to ensure that the latent image attracts the liquid toner thereto. A vacuum is maintained on the liquid toner to reduce the thickness of the film coating the photoconductive surface. This minimizes the tolerances of the gap between the lip and the photoconductive surface.

It is, therefore, apparent that there has been provided, in accordance with the present invention, an apparatus for developing an electrostatic latent image with liquid toner. This apparatus fully satisfies the aims and advantages hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

I claim:

1. An apparatus for developing an electrostatic latent image with liquid toner, including;

a member comprising a lip adapted to supply liquid toner to the latent image to develop the latent image with a layer of liquid toner with the space between said lip and the latent image being greater than the thickness of the layer of liquid toner on the latent image;

means for reducing the pressure on the liquid toner as said member applies the liquid toner to the latent image to reduce the thickness of liquid toner on the latent image; and means for electrically biasing said lip to attract the liquid toner from said lip to the latent image.

2. An apparatus according to claim 1, further including means for supplying liquid toner to said lip, said member defining an aperture at least partially coupling said supplying means with said lip.

3. An apparatus according to claim 2, further including means for pumping liquid toner from said supplying means through the aperture to said lip.

4. An apparatus according to claim 3, wherein said member includes:

a first member; and a second member mounted on said first member to define the aperture there between.

5. An apparatus according to claim 4, wherein said second member defines a distribution channel and a supply channel extending in a direction transverse thereto, to form the aperture with the supply channel connecting said supplying means to said distribution channel to supply liquid toner to said lip.

6. An apparatus according to claim 5, wherein said second member includes a substantially planar surface spaced from and opposed to the latent image to form said lip.

7. An apparatus according to claim 6, wherein the space between said lip and the latent image is less than seven times the thickness of the layer of liquid toner on the latent image.

8. An apparatus according to claim 7, wherein the thickness of the layer of liquid toner on the latent image is less than 1 mil.

9. An electrostatic printing machine, including:

and imaging surface;

means for recording an electrostatic latent image on said imaging surface; and means for developing the electrostatic latent image recorded on said imaging surface with a liquid toner, said developing means comprising a member having a lip adapted to supply the liquid toner to the latent image to develop the latent image with a layer of the liquid toner with the space between said lip and the latent image being greater than the thickness of the layer of liquid toner on the latent image, means for electrically biasing said lip to attract the latent image from said lip to the electrostatic latent image, and means for reducing the pressure on the liquid toner as said member applies the liquid toner on the latent image to reduce the thickness of liquid toner on the latent image.

10. A printing machine according to claim 9, wherein said developing means comprises means for supplying liquid toner to said lip, said member defining an aperture at least partially coupling said supplying means with said lip.

11. A printing machine according to claim 10, wherein said developing means comprises means for pumping the liquid toner from said supplying means through the aperture to said lip.

12. A printing machine according to claim 11, wherein said member of said developing means comprises a first member and a second member mounted on said first member to define the aperture therebetween.

13. A printing machine according to claim 14, wherein said second member defines a distribution channel and a supply channel extending in a direction transverse thereto to form the aperture with the supply channel connecting said supplying means to said distribution channel to supply liquid toner to said lip.

14. A printing machine according to claim 13, wherein said second member includes a substantially planar surface spaced from and opposed to the imaging surface to form said lip.

15. A printing machine according to claim 14, wherein the space between said lip and the imaging surface is less than seven times the thickness of the layer of liquid toner on the latent image developed on said imaging surface.

16. A printing machine according to claim 15, wherein the thickness of the layer of liquid toner on the latent image is less than 1 mil.

17. A printing machine according to claim 9, further including:

means for transferring the liquid toner from said imaging surface to a sheet; and means for fusing the liquid toner to the sheet.

18. A multicolor electrostatic printing machine, including:

an imaging surface;

means for recording a plurality of electrostatic latent images on said imaging surface; and means for developing each of the electrostatic latent images recorded on said imaging surface with a different color liquid toner, said developing means comprising a plurality of members with each of said plurality of members having a lip adapted to supply the liquid toner to the latent image to develop the latent image with a layer of the liquid toner with the space between said lip and the latent image being greater than the thickness of the layer of liquid toner on the latent image developed on said imaging surface, means for electrically biasing said lip to attract the liquid toner from said lip to the latent image, and means for reducing the pressure on the liquid toner as said member applies the liquid toner on the latent image to reduce the thickness of the liquid toner on the latent image.

19. A printing machine according to claim 18, wherein said imaging surface moves through a repeating cycle, said recording means recording one of the plurality of electrostatic latent images on said imaging surface during each cycle and said developing means developing each electrostatic latent image with different color liquid toner during each cycle in superimposed registration to form a multicolor liquid toner image.

20. A printing machine according to claim 19, further including:

means for transferring the multicolor liquid toner image from said imaging surface to a sheet; and means for fusing the multicolor liquid toner image to the sheet.

21. A printing machine according to claim 20, wherein said developing means comprises means for supplying liquid toner to said lip, said member defining an aperture at least partially coupling said supplying means with said lip.

22. A printing machine according to claim 21, wherein said developing means comprises means for pumping liquid toner from said supplying means through the aperture to said lip.

23. A printing machine according to claim 22, wherein said member of said developing means comprises a first member and a second member mounted on said first member to define the aperture therebetween.

24. A printing machine according to claim 23, wherein said second member defines a distribution channel and a supply channel extending in a direction transverse thereto to form the aperture with the supply channel connecting said supplying means to said distribution channel to supply liquid toner to said lip.

25. A printing machine according to claim 24, wherein said second member includes a substantially planar surface spaced from and opposed to the imaging surface to form said lip.

26. A printing machine according to claim 25, wherein the space between said lip and the latent image is less than seven times the thickness of the layer of liquid toner on the latent image developed on said imaging surface.

27. A printing machine according to claim 26, wherein the thickness of the layer of each liquid color toner on the latent image is less than 1 mil.

* * * * *